US010077643B2

(12) United States Patent
Dallas

(10) Patent No.: US 10,077,643 B2
(45) **Date of Patent: *Sep. 18, 2018**

(54) METHOD OF COMPLETING AND PRODUCING LONG LATERAL WELLBORES

(71) Applicant: Lloyd Murray Dallas, Streetman, TX (US)

(72) Inventor: Lloyd Murray Dallas, Streetman, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/485,470

(22) Filed: Apr. 12, 2017

(65) Prior Publication Data

US 2017/0218739 A1 Aug. 3, 2017

Related U.S. Application Data

(63) Continuation of application No. 14/827,722, filed on Aug. 17, 2015, now Pat. No. 9,644,463.

(51) Int. Cl.

| | |
|---|---|
| ***E21B 43/14*** | (2006.01) |
| ***E21B 47/00*** | (2012.01) |
| ***E21B 7/04*** | (2006.01) |
| ***E21B 43/11*** | (2006.01) |
| ***E21B 43/26*** | (2006.01) |
| ***E21B 33/12*** | (2006.01) |
| ***E21B 43/16*** | (2006.01) |
| ***E21B 43/12*** | (2006.01) |

(52) U.S. Cl.

CPC ..... *E21B 43/14* (2013.01); *E21B 7/046* (2013.01); *E21B 33/12* (2013.01); *E21B 43/11* (2013.01); *E21B 43/127* (2013.01); *E21B 43/16* (2013.01); *E21B 43/26* (2013.01); *E21B 47/00* (2013.01)

(58) Field of Classification Search

CPC ..... E21B 7/04; E21B 43/14; E21B 43/16

See application file for complete search history.

(56) References Cited

U.S. PATENT DOCUMENTS

| | | | |
|---|---|---|---|
| 3,741,300 | A | 6/1973 | Wolff et al. |
| 4,478,945 | A | 10/1984 | Hearn |
| 4,945,995 | A | 8/1990 | Tholance et al. |
| 5,205,385 | A | 4/1993 | Quintana |
| 5,311,954 | A | 5/1994 | Quintana |
| 5,411,082 | A | 5/1995 | Kennedy |
| 5,427,177 | A | 6/1995 | Jordan et al. |
| 5,526,880 | A | 6/1996 | Jordan et al. |
| 5,626,193 | A | 5/1997 | Nzekwu et al. |

(Continued)

FOREIGN PATENT DOCUMENTS

WO PCT/US2014/013225 A1 10/2014

OTHER PUBLICATIONS

Energy Information Administration—"Drilling Sideways—A Review of Horizontal Well Technology and its Domestic Application", Apr. 1993, DOE/EIA-TR-0565; Distribution Category UC-950.

*Primary Examiner* — Matthew R Buck
*Assistant Examiner* — Aaron Lloyd Lembo
(74) *Attorney, Agent, or Firm* — J. Bennett Mullinax, LLC

(57) ABSTRACT

Long lateral wellbores are prepared for the production of hydrocarbons by preparing only a portion of the wellbore for production at a time, starting at a remote end of the long lateral wellbore. The prepared production section is produced until production becomes uneconomic before a further production section is prepared and produced.

20 Claims, 9 Drawing Sheets

(56) References Cited

U.S. PATENT DOCUMENTS

| | | | | |
|---|---|---|---|---|
| 5,730,221 | A | 3/1998 | Longbottom et al. | |
| 5,884,704 | A | 3/1999 | Longbottom et al. | |
| 5,960,883 | A | 10/1999 | Tubel et al. | |
| 5,988,278 | A | 11/1999 | Johnson | |
| 6,230,803 | B1 | 5/2001 | Morton et al. | |
| 6,662,870 | B1 | 12/2003 | Zupanick et al. | |
| 6,729,394 | B1 | 5/2004 | Hassan et al. | |
| 6,907,930 | B2 | 6/2005 | Cavender et al. | |
| 6,986,388 | B2 * | 1/2006 | Zupanick ..... | E21B 7/046 166/245 |
| 7,059,402 | B2 | 6/2006 | Lima et al. | |
| 7,059,415 | B2 | 6/2006 | Bossma et al. | |
| 7,104,320 | B2 | 9/2006 | Buchanan et al. | |
| 7,377,322 | B2 | 5/2008 | Hoffman | |
| 7,431,091 | B2 | 7/2008 | Themig | |
| 7,464,756 | B2 | 12/2008 | Gates | |
| 7,513,042 | B2 | 4/2009 | Stayton | |
| 8,127,845 | B2 | 3/2012 | Assal | |
| 8,220,547 | B2 | 7/2012 | Craig et al. | |
| 8,528,639 | B2 | 9/2013 | Fang et al. | |
| 8,459,355 | B2 | 11/2013 | Schultz et al. | |
| 8,651,177 | B2 | 2/2014 | Vail, III | |
| 8,848,528 | B1 | 2/2014 | Saurez-Rivera et al. | |
| 9,249,652 | B2 | 2/2016 | Montgomery | |
| 9,303,501 | B2 | 4/2016 | Fehr | |
| 9,366,123 | B2 | 6/2016 | Fehr | |
| 2004/0261990 | A1 | 12/2004 | Bosma et al. | |
| 2005/0082081 | A1 | 4/2005 | Nguyen et al. | |
| 2007/0158073 | A1 | 7/2007 | Green | |
| 2008/0164026 | A1 | 10/2008 | Johnson | |
| 2009/0159279 | A1 | 6/2009 | Assal | |
| 2009/0260814 | A1 | 10/2009 | Malone | |
| 2011/0024121 | A1 | 2/2011 | Skeates et al. | |
| 2013/0228337 | A1 | 9/2013 | Dombrowski et al. | |
| 2013/0327572 | A1 | 12/2013 | Sponchia et al. | |
| 2015/0007988 | A1 | 1/2015 | Ayasse | |
| 2015/0007996 | A1 | 1/2015 | Ayasse | |
| 2016/0215581 | A1 | 1/2016 | Ingraham et al. | |
| 2016/0069182 | A1 | 3/2016 | Neale et al. | |

* cited by examiner

METHOD OF COMPLETING AND PRODUCING LONG LATERAL WELLBORES

RELATED APPLICATIONS

This is a continuation of U.S. patent application Ser. No. 14/827,722 filed Aug. 17, 2015.

FIELD OF THE INVENTION

This invention relates in general to wellbore completion and hydrocarbon production and, in particular, to a novel method of completing and producing long lateral wellbores.

BACKGROUND OF THE INVENTION

When a well is drilled, production casing is set so that the well can be properly cemented and the production zone(s) do not have fluid communication, with other geological strata. The production zone is logged and then the production casing is perforated so that oil and/or gas can be drained from the production zone into the production casing of the well. Traditionally, hydrocarbon wells were drilled vertically down to and through one or more hydrocarbon production zone(s). As shown in FIG. 1, a vertical wellbore 10 having a production casing 12 passes through a hydrocarbon production zone 14. A plurality of perforations (not shown) formed in the production casing 12 using methods well known in the art permit hydrocarbons 16 to flow into the production casing 12. The casing perforations also permit the production zone 14 to be treated to stimulate production by creating a plurality of fractures 18 in the production zone 12 using, for example, hydraulic fracturing techniques that are well known in the art. A production tubing 20 is used to deliver the hydrocarbons 16 to the surface. A packer 22 seals the annulus between the production tubing 20 and the production casing 12.

Vertical wellbores have now been substantially abandoned in favor of more productive lateral wellbores that provide more exposure to the production zone. Although the first recorded true lateral well was drilled near Texon, Tex. in 1929, new technology developed over the last decade has permitted lateral drilling techniques to rapidly evolve. Hydrocarbon wells are now drilled vertically to a point above the production zone and then curved so that the wellbore enters the production zone at an angle and continues laterally within the production zone for more in-zone exposure to the hydrocarbon bearing formation. Some production zones are up to 300 feet (91.5 meters) thick, or more, and with lateral drilling techniques casing can be run up to 8,000 ft. (2.44 kilometers) into the production zone, thus providing significantly more area for hydrocarbons to drain into the production casing.

FIG. 2 is a schematic cross-sectional diagram of an exemplary prior art hydrocarbon well 30 with a lateral wellbore. Well know features such as the conductor and surface casing are not shown. A vertical section 32 of the hydrocarbon well 30 is drilled down into proximity of a production zone 14, cased and cemented in a manner well known in the art. In many areas, the vertical section of the well may be 10,000 feet (3.05 kilometers) in length. In some areas the vertical section may exceed 10,000 feet (3.05 kilometers) in length. A curved section 34 of the hydrocarbon well 30 is then drilled into the production zone 14. Once it is established that the curved section 34 is in the production zone 14, a lateral wellbore 36 is drilled in a desired direction in as straight a path as possible within the production zone 14. Recent innovations in work strings for completing lateral wellbores described in applicant's co-pending U.S. patent application Ser. No. 14/735,846 filed Jun. 10, 2015, the specification of which is incorporated herein by reference, permit lateral wellbores of at least 12,000 feet (3.66 kilometers) to be successfully completed. After the lateral wellbore 36 is drilled, a production casing 38 is run into the lateral wellbore 36. The production casing 38 is generally "cemented in" before it is perforated for production. In any event, sections of the production casing 38 are perforated and stimulated using methods known in the art until an entire length of the production casing 38 has been perforated and the surrounding production zone 14 has been stimulated. A production tubing 42 is then run into the well and a packer 44 is set to seal the annulus. In a very long lateral bore, stimulation of the production 14 surrounding the lateral well bore 36 is a major undertaking and now costs more than drilling, casing and cementing the bore. Once stimulation and flow-back of stimulation fluids are completed, production of hydrocarbons from the wellbore 30 begins. In a shale basin such as found in the Bakken, play, production is generally commercially viable for about 2 years, and may be extended by reworking the well using methods known in the art.

While the lateral wellbore method has been commercially successful, the potential for innovative production strategies has yet to be realized.

There therefore exists a need for a novel method of completing and producing long lateral wellbores.

SUMMARY OF THE INVENTION

It is therefore an object of the invention to provide a novel method of completing and producing long lateral wellbores.

The invention therefore provides a method of producing hydrocarbons from a cased and cemented long lateral wellbore, comprising: preparing a first production section of the long lateral wellbore for production, the first production section having a length of less than a total length of the long lateral wellbore; producing hydrocarbons from the first production section until production from the first production section is uneconomic; setting a plug to plug off the first production section of the long lateral wellbore; preparing a next production section of the long lateral wellbore for production, the next production section having a length of less than a total length of the long lateral wellbore; producing hydrocarbons from the next production section until production from the next production section is uneconomic; if hydrocarbons have not been produced, from the entire long lateral wellbore, plugging off the next production section of the long lateral wellbore; and repeating the steps of preparing a next production section and producing from the next production section until an entire length of the long lateral wellbore has been prepared for production and produced until production from the long lateral wellbore is uneconomic.

The invention further provides a method of producing hydrocarbons from a cased and cemented long lateral wellbore, comprising: preparing a first production section of the long lateral wellbore for production, the first production section having a length of less than a total length of the long lateral wellbore; producing hydrocarbons from the first production section until production from the first production section is uneconomic; pulling production equipment from the long lateral wellbore; setting a plug to plug off the first production section of the long lateral wellbore; preparing a next production section of the long lateral wellbore for production, the next production section having a length of less than a total length of the long lateral wellbore; running the production equipment back into the long lateral wellbore; producing hydrocarbons from the next production section until production from the next production section is uneconomic; pulling the production equipment from the long lateral wellbore; pulling the plug from the long lateral wellbore; running the production equipment back into the long lateral wellbore, until a packer is in an unperforated region between the first and next production sections of the long lateral wellbore; setting the packer in the unperforated region; installing a tubing at a wellhead of the long lateral well bore; pumping enhanced oil recovery flood fluid through the tubing into an annulus of a production casing of the long lateral wellbore, and hence down the annulus and through perforations in the production casing of the next production section; and producing hydrocarbons through a production tubing associated with the packer until the production of hydrocarbons is uneconomic.

The invention yet further provides a method of producing hydrocarbons from a cased and cemented long lateral wellbore, comprising: drilling a plurality of long lateral wellbores from a single well pad; preparing a first production section of each of the long lateral wellbores for production, the first sections having a length of less than a total length of the respective long lateral wellbores; producing hydrocarbons from, the first production sections of the respective long lateral wellbores until production from the respective first production sections becomes uneconomic; setting a plug to plug off the first production section of each of the respective long lateral wellbores; preparing a next production section of the respective long lateral wellbores for production, the respective next sections having a length of less than a total length of the respective long lateral wellbores; producing hydrocarbons from the respective next production sections until production from the respective next production sections becomes uneconomic; if hydrocarbons have not been produced from an entire length of the respective long lateral wellbores, plugging off the next production section of the respective long lateral wellbores; and repeating the steps of preparing a next production section and producing from the next production section until an entire length of the respective long lateral wellbores have been prepared for production and produced until production from the respective long lateral wellbores becomes uneconomic.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a method of completing lateral wellbores that leverages the potential of long lateral wellbores enabled by current lateral boring and completion equipment and techniques. Lateral wellbores in excess of 12,000 linear feet (3.66 kilometers) may now be drilled and completed. In accordance with the invention, such wellbores are completed in two or more production sections, and hydrocarbon is produced from each production section until production from that production section is exhausted or no longer commercially viable. In, accordance with a further aspect of the invention, 2 or more lateral wellbores are drilled from the same drill pad and each wellbore is produced in production sections until all the wellbores in each pad have been produced. In, accordance with a yet a further aspect of the invention, perforation and stimulation of each production section is carefully planned to permit the respective production sections to be re-stimulated if desired. In accordance with yet a further aspect of the invention, enhanced oil recovery (EOR) is practiced within a lateral wellbore by pumping EOR flood fluids down a work string into a first production section and producing hydrocarbons up the annulus of the production casing from a second production section, or pumping EOR flood fluids down the annulus of the production casing into the second production section and producing hydrocarbons up the work string from the first production section.

Figure 1:
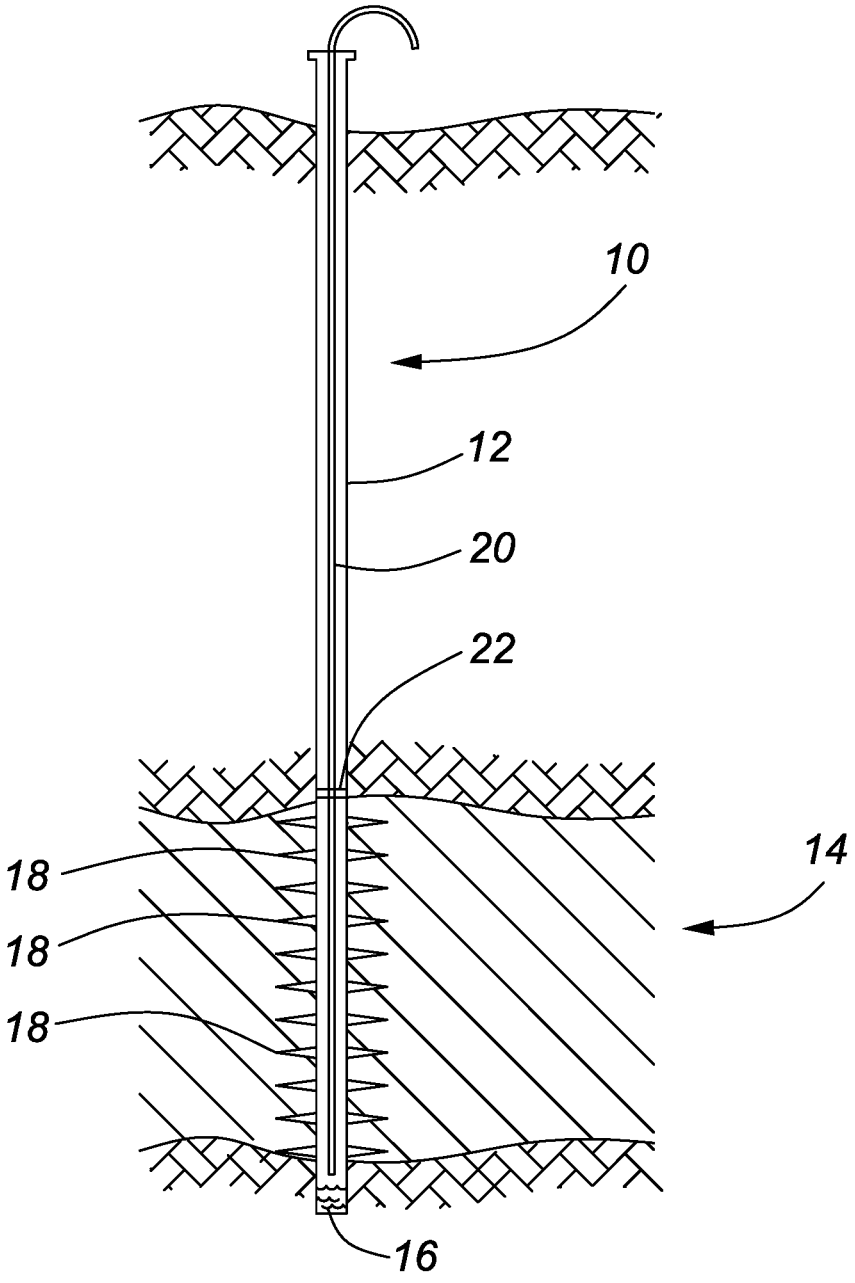
(PRIOR ART) FIG. 1
FIG. 1 is a schematic cross-sectional diagram of an exemplary prior art vertical hydrocarbon well.
Figure 2:
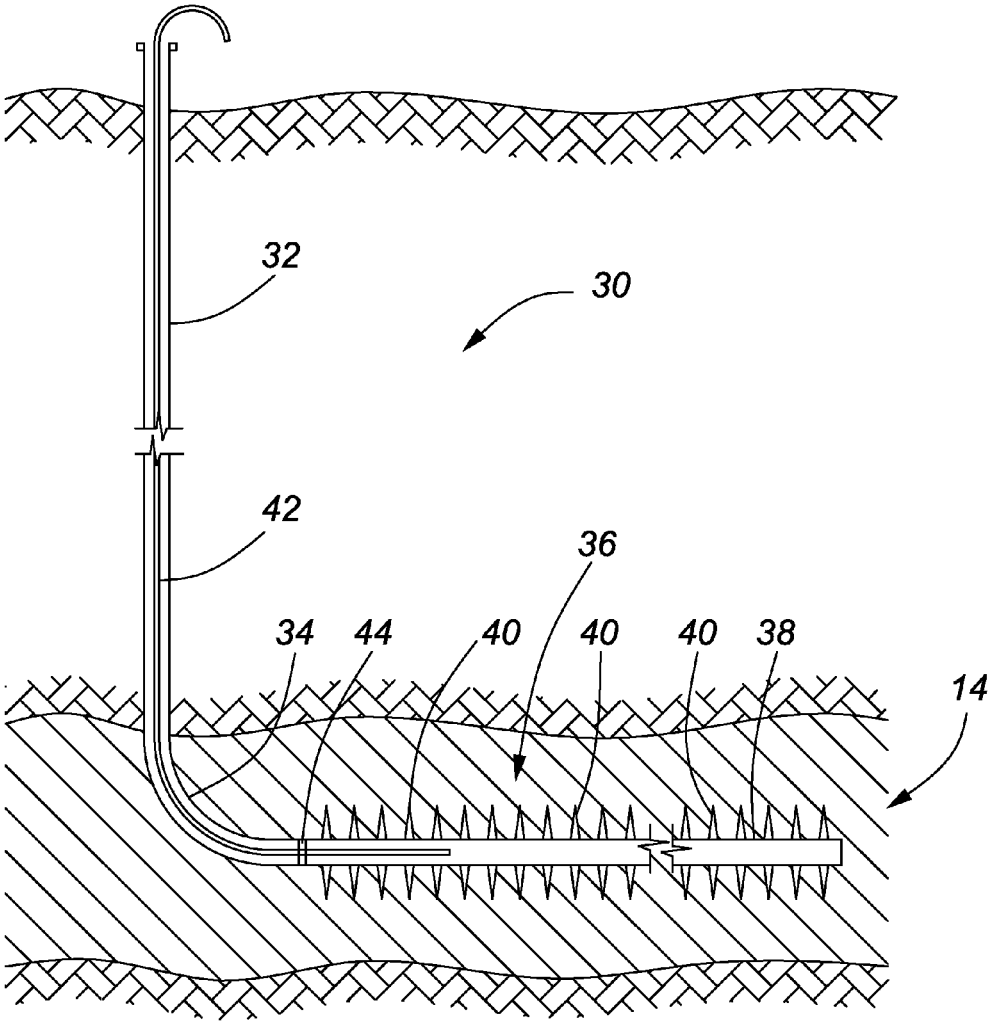
(PRIOR ART) FIG. 2
FIG. 2 is a schematic cross-sectional diagram of an exemplary prior art lateral hydrocarbon well.
Figure 3:
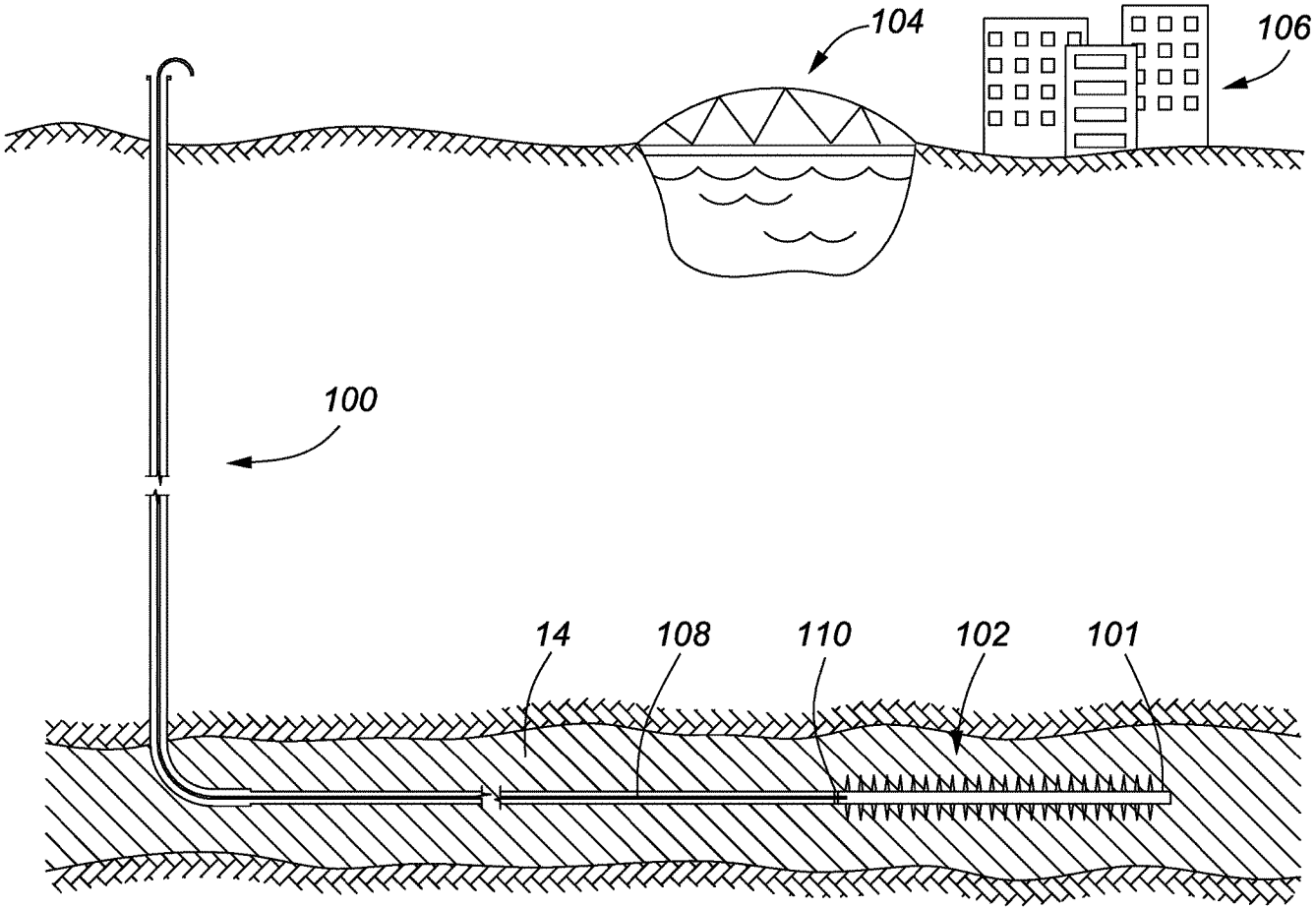
FIG. 3 is a schematic-cross sectional diagram of a lateral hydrocarbon well with a first section completed for production using the method in accordance with the invention.

FIG. 3 is a schematic-cross sectional diagram of a lateral hydrocarbon well 100 having a production casing 101, with a first production section 102 completed for production using the method in accordance with the invention. Modern drilling techniques permit very long lateral wellbores to be drilled and completed. This permits hydrocarbon deposits under natural bodies of water such as rivers 104 and/or cities 106 to be exploited without inconvenience or disturbance to surface features. In accordance with the method, after the long lateral wellbore is drilled, cased and cemented, only the first production section 102 at the farthest reach of the production casing 101 is perforated and stimulated for production. A length the first production section 102 is a matter of design choice and may depend on any one or more of a number of factors including: a production potential of the production zone 14; current or projected price for hydrocarbon products to be produced from the production section; current investment funds available for production stimulation treatments; availability of stimulation service providers; desired lifetime of the entire well; etc. In general each production section 102 has a recommended length of 2,000'-4,000' (600-1,200 meters), or at most less than the entire length of the lateral wellbore of the hydrocarbon well 100. Keeping production section 102 at a length of 4,000' (1,200 meters) or less permits service providers to achieve a more focused stimulation treatment, which results in better production per linear foot of wellbore. Each production section 102 may also have a different length, as described below in more detail. An operator may decide to have 3 production sections in a 12,000 ft. lateral wellbore. The furthest production section out from the vertical wellbore may be 3,000' in length. The second production section may be 4,000' in length, and the last section would therefore be about 5,000' in length.

After the first production section 102 of production casing 101 has been prepared for production using production casing perforation and formation stimulation techniques well known in the art, flow-back of stimulation fluids is performed in accordance with methods that are also known in the art. After flow-back, production from the hydrocarbon well 100 may commence. Depending on the production formation 14, hydrocarbon may be initially produced up the production casing 101. After production up the production casing 101 is not viable, a production tubing 108 is then run into the well. A packer 110 is set to seal the annulus around the production tubing 108 and production from the hydrocarbon well 100 continues or commences. A pump assisted lift may be required to produce hydrocarbons from the production section 102, as understood by those skilled in the art. Production from the production section 102 continues until production from that production section is no longer commercially viable.

Figure 4:
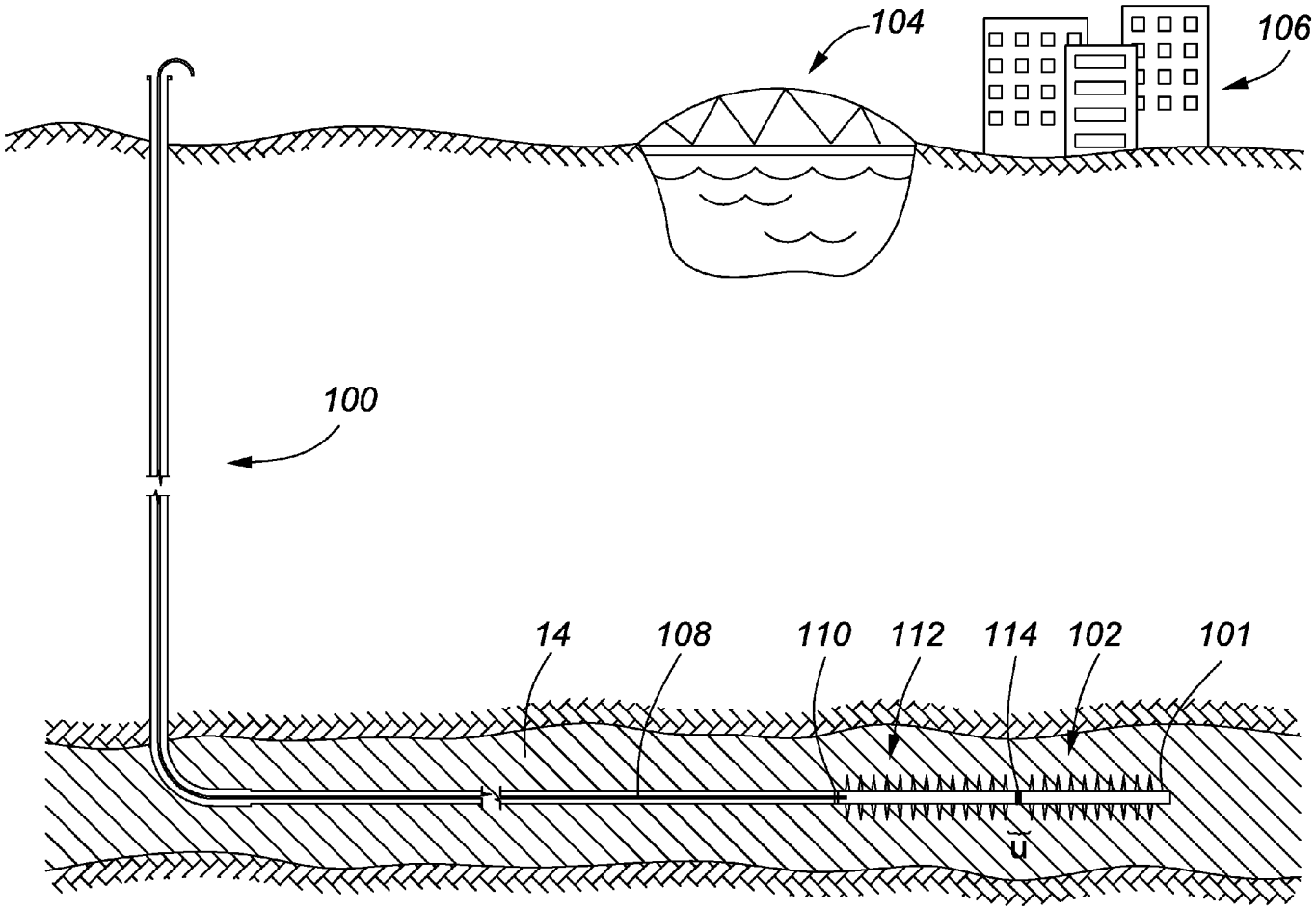
FIG. 4 is a schematic-cross sectional diagram of the lateral hydrocarbon well shown in FIG. 3 with a second section completed using the method in accordance with the invention.

FIG. 4 is a schematic-cross sectional diagram of the lateral hydrocarbon well 100 shown in FIG. 3 with a second production section 112 of the production casing 101 completed using the method in accordance with the invention. Once production from production section 102 is no longer viable, the production tubing 108 and packer 110 are pulled from the well and a re-stimulation of section 102 may be performed to prolong production. Alternatively, a plug 114 is set in the unperforated interval "u" of the production casing 101, where the packer 110 had been set. Perforating equipment (not shown) is then run into the production casing 101 and the production second section 112 is perforated and stimulated until an entire length of the second section 112 of the production casing 101 is prepared for production. A length of the unperforated section "u" left between the sections 102 and 112 is preferably at least one production casing joint (40'-12.2 m) in length and may be up to two casing joints in length. A length of the new production section 112 may be determined using production information collected during production from production section 102. Consequently, new production section 112 may be longer, shorter, or the same length as production section 102 depending on production targets and any other factor relevant to operation of the hydrocarbon well 100. An operator may also consider changing the stimulation treatment or service provider when stimulating the second production section 112 to determine the efficacy of a different treatment/service provider because production yields from the production sections 102 and 112 provide a direct comparison of stimulation efficacy since production from each section is from the same wellbore in the same production zone. Once stimulation and flow-back of stimulation fluids are completed, the production tubing 108 and the packer 110 are then run back into the wellbore and the packer 110 is reset. Production from the second production section 112 then commences and continues until the production from production section 112 is no longer economically viable, at which time the production section 112 may be plugged off, and the process of preparing another production section may be repeated until the entire lateral wellbore has been produced. Alternatively, enhanced oil recovery (EOR) may be performed, as described below with reference to FIGS. 6-8, or re-stimulation of production sections 102 and 112, or production section 112 alone, may be performed as described below with reference to FIG. 5.

Figure 5:
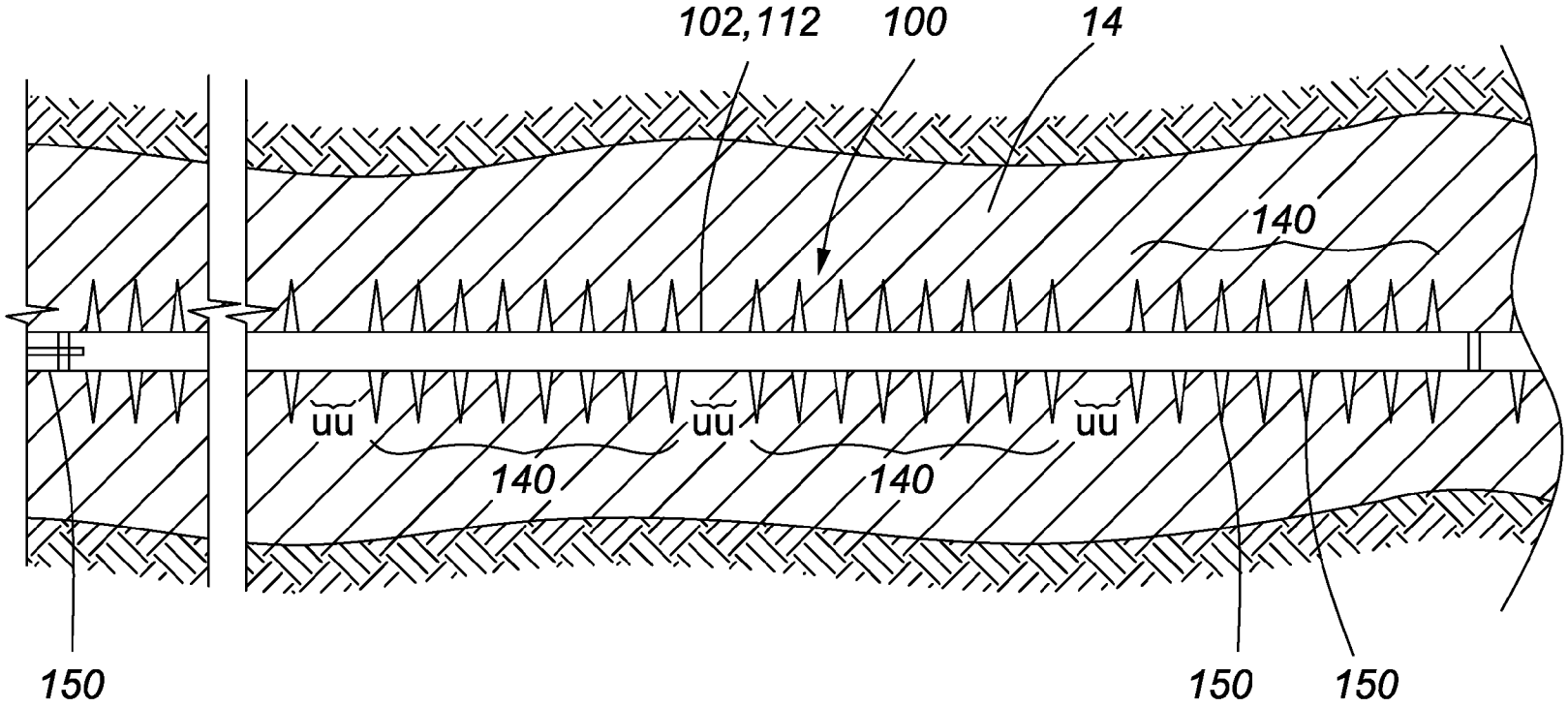
FIG. 5 is a schematic cross-sectional diagram of a portion of a lateral wellbore completed using a method in accordance with the invention.

FIG. 5 is a schematic cross-sectional diagram of a portion of one of the lateral wellbores 100 with a production casing 101 in the production zone 14 completed using a method in accordance with a further aspect of the invention. In accordance with the invention, initial perforation and stimulation of each production section 102, 112 (see FIG. 4) of the lateral wellbore 100 is carefully planned with consideration to the potential of re-stimulation of the respective production sections 102, 112 at a later date when a second stimulation procedure may be used to extend a life of the production section(s) 102, 112. Since re-stimulation must be done down a work string, which limits the flow rate of stimulation fluids, careful consideration must be given to the length of perforations that can be re-stimulated taking into account the distance of the production section 102, 112 from the wellhead, the diameter of the production casing 101, which determines a diameter of the work string that may be used, pressure loss in the work string, etc. Consequently, unperforated intervals "uu" are left between perforated runs 140 where fractures 150 are created by stimulation fluids. The unperforated intervals "uu" are long enough to ensure that stimulation fluids are unlikely to migrate down a backside of the production casing 101 during the re-stimulation procedure as this could have detrimental effects that would require expensive remediation.

Figure 6:
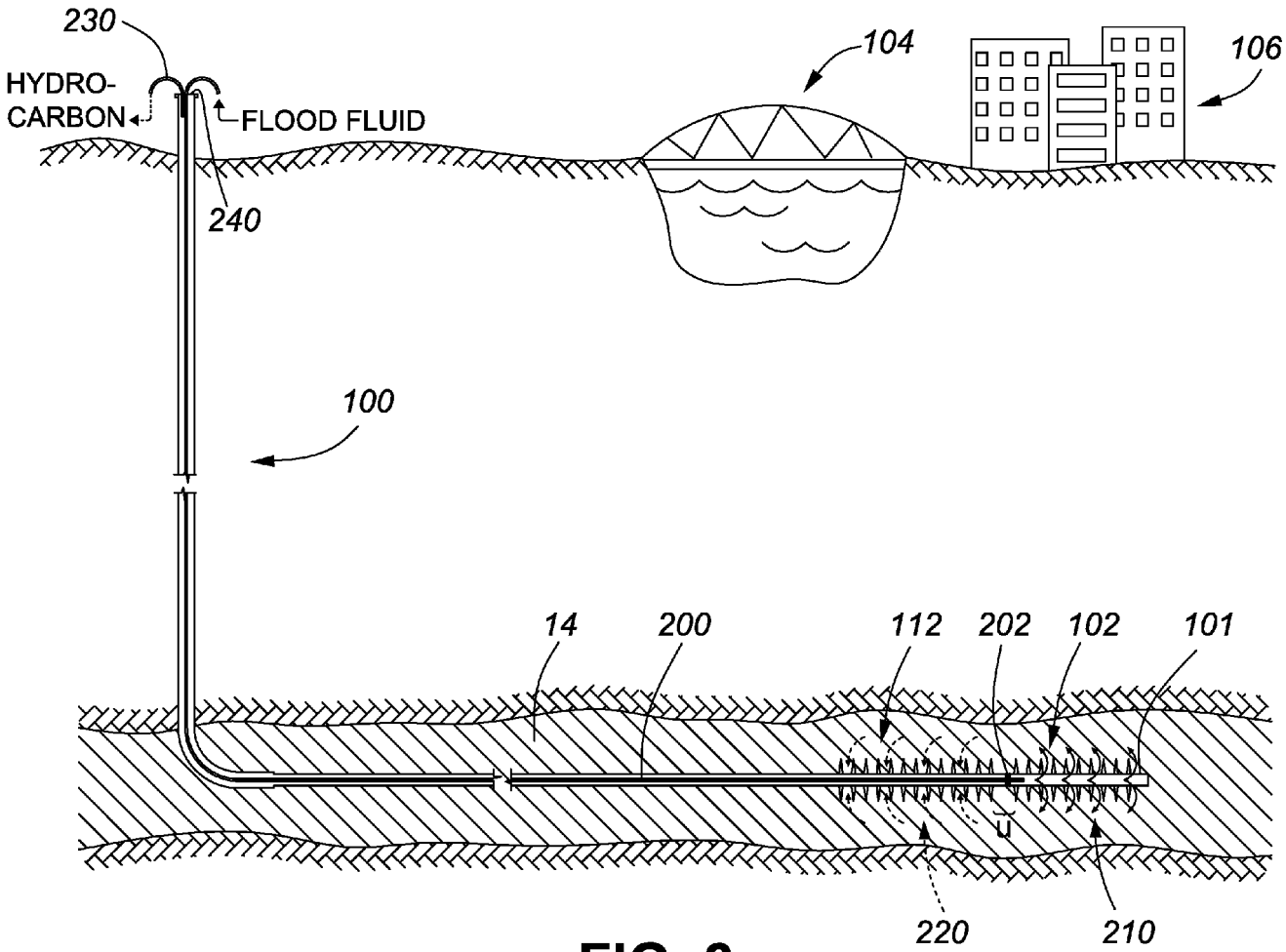
FIG. 6 is a schematic cross-sectional diagram of the lateral hydrocarbon well shown in FIG. 4 configured for enhanced oil recovery using the method in accordance with the invention.

FIG. 6 is a schematic-cross sectional diagram of the lateral hydrocarbon well 100 shown in FIG. 4 configured for enhanced oil recovery (EOR) using the method in accordance with the invention. After section 112 has been produced, or substantially produced, EOR may be considered to extract remaining hydrocarbon from the production zone 14 in production sections 102, 112. In accordance with one aspect of the invention EOR may be performed by removing the production tubing 108 and the packer 110 shown in FIG. 4. The plug 114 is also removed (see FIG. 4). A work string 200 and packer 202 are then run into the well 100 until the packer 202 can be set in the unperforated interval "u" between production sections 102 and 112 where the plug 114 had been set. In one embodiment the work string 200 is the work string described in applicant's above-referenced U.S. patent application Ser. No. 14/735,846, though if the run through the lateral bore is not too long coil tubing or jointed tubing such as Hydril® PH6® be used as the work string 200. Once the packer 102 is set, an EOR flood fluid 210 such as, for example, carbon dioxide ($CO_2$), liquid nitrogen ($LN_2$), compressed natural gas (CNG), water ($H_2O$), or brine is pumped from the surface down the work string 200. The pressurized flood fluid enters the production zone 14 through the perforations in the production casing 101 of production section 102. As the pressurized EOR flood fluid enters the production formation 14, remaining hydrocarbon 220 is urged along a path of least resistance through the perforations in section 112 and up the annulus of the production casing 101 to the surface where it is produced through a production tubing 230 installed at the wellhead 240. Using, this method, EOR fluids are pumped into section 102 until the EOR flood fluid flows up the annulus of the production casing 101 to the wellhead 240.

Figure 7:
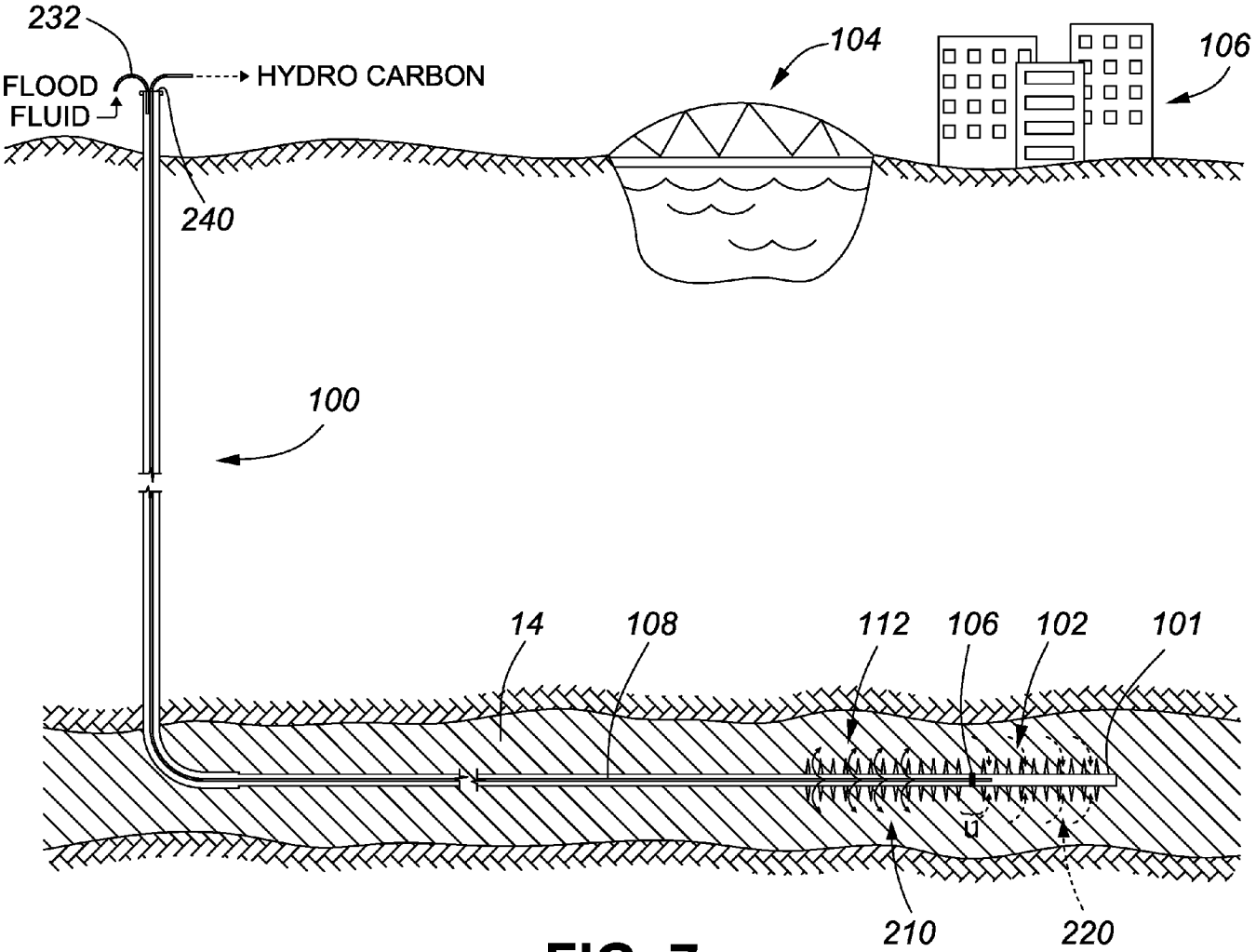
FIG. 7 is a schematic cross-sectional diagram of, the lateral hydrocarbon well shown in FIG. 4 configured in another way for enhanced oil recovery using the method in accordance with the invention.

FIG. 7 is a schematic-cross sectional diagram of the lateral hydrocarbon well 100 shown in FIG. 4 configured in another way for EOR using the method in accordance with the invention. In this configuration, the production tubing 108 and the packer 110 are left in the well and EOR flood fluid 210 is pumped down the annulus through tubing 232 installed at the wellhead 240. Since the production casing 101 is unperforated above production section 112, the EOR, flood fluid 210 is forced through the perforations in production section 112 into the production zone 14. Hydrocarbons 220 in the production zone 14 are urged by the EOR flood fluid 210 along the path of least resistance through the perforations in production section 102, where they enter the production casing 101. The hydrocarbons 220 are contained by the packer 106 and are forced up the production tubing 108 to the surface. Generally after an initial production period, there is no longer enough downhole pressure to force hydrocarbons 220 to the surface whether under normal production conditions or under EOR. Consequently, a pump is required to move the hydrocarbons 220 to the surface, an example of which is explained below in more detail with reference to FIG. 8.

Figure 8:
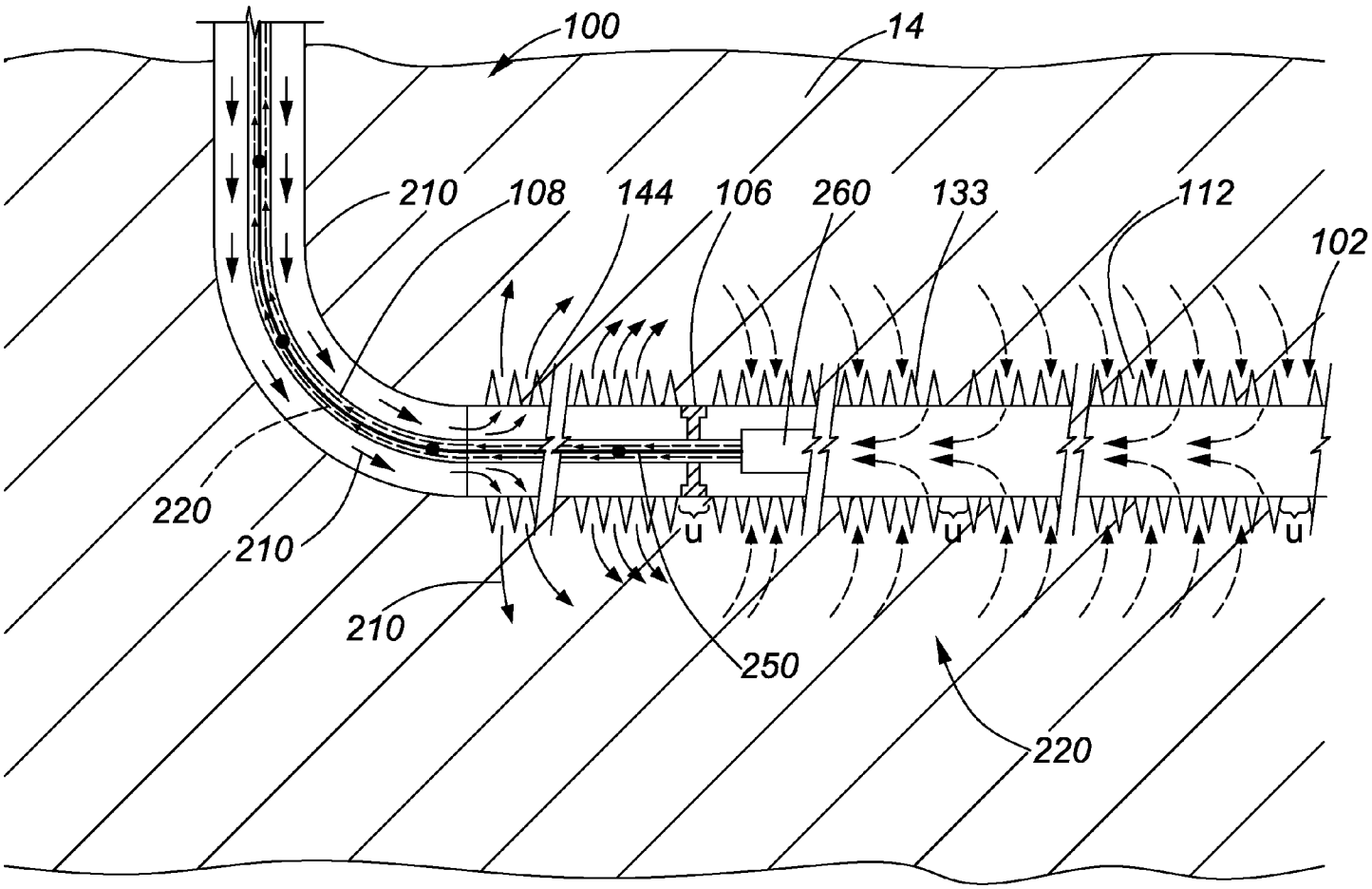
FIG. 8 is a schematic cross-sectional diagram of a detail of a lateral hydrocarbon well configured for enhanced oil recovery in accordance with the invention.

FIG. 8 is a schematic cross-sectional diagram of a more detailed example of a lateral hydrocarbon well 100 configured for EOR in accordance with the invention. FIG. 8 is not drawn to scale. As shown in FIG. 8, a lateral wellbore 100 with four production sections 102, 112, 133 and 144. Each of the production sections 102, 112, 133 and 144 are separated by an unperforated region "u". Each unperforated region "u" being at least one casing joint in length, as described above with reference to FIG. 3. In this example, all four production sections 102, 112, 133 and 144 have been perforated, stimulated and produced. The production tubing 108 and packer 106 are then pushed down the production casing 101 past production section 144 and the packer 106 is set in the unperforated region "u" between production sections 144 and 133. As explained above with reference to FIG. 7, EOR flood 210 fluid is then pumped down the annulus from the wellhead 240 (see FIG. 7). The EOR flood fluid 210 is forced through perforations in the production section 144 and into the production zone 14. Hydrocarbons remaining in the production zone 14 are urged along a path of least resistance through the perforations in production sections 133, 112 and 102 and into the production casing 101. The hydrocarbons 220 are lifted to the surface through the production tubing 108 by a plunger pump 260. A sucker rod string 250 drives the plunger pump 260, which is connected to the end of the production tubing 108. The plunger pump 260 lifts the hydrocarbons 220 to the surface in a manner well known in the art. The sucker rod string is reciprocated by a balanced beam pump jack, commonly referred to as a "nodding donkey", (not shown) in a manner well known in the art.

Figure 9:
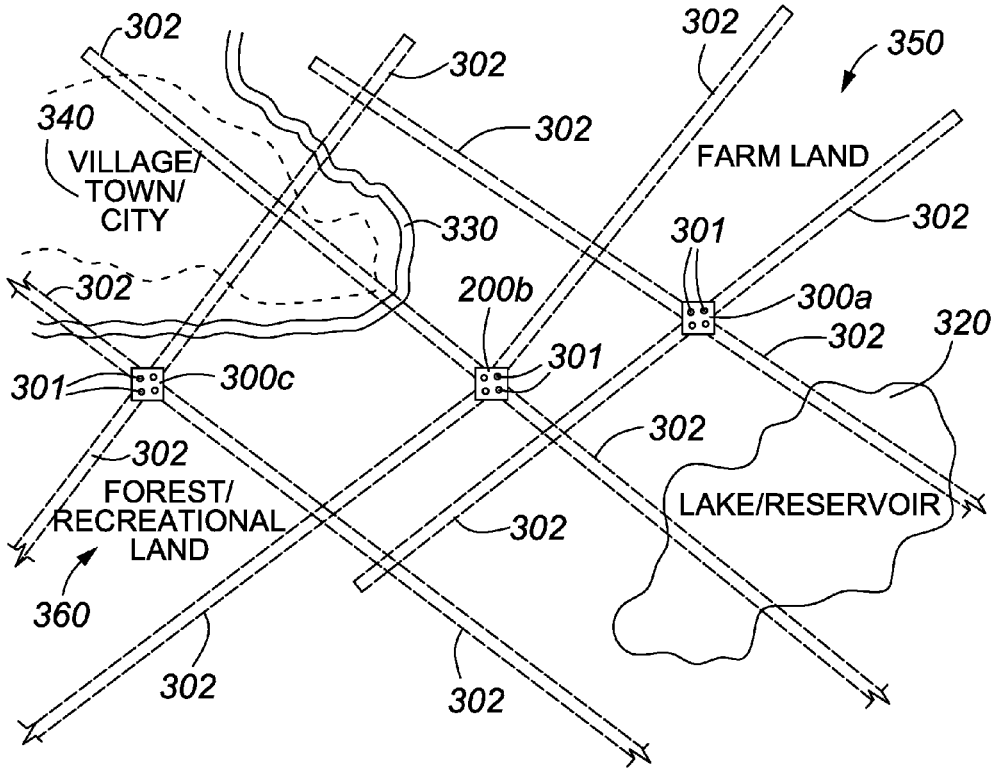
FIG. 9 is a schematic diagram of lateral hydrocarbon wells drilled using methods in accordance with the invention.

FIG. 9 is a schematic diagram of lateral hydrocarbon wells drilled using methods in accordance with a further aspect of the invention. In accordance with this aspect of the invention hydrocarbon wells are concentrated on well pads 300*a-c*, which are located in convenient and unobtrusive locations, such as public road allowances off main rural roads, or the like, to minimize environmental impact while maximizing year round access. Each pad accommodates at least 2 hydrocarbon wells. In this example, each well pad 300 accommodates 4 lateral wells 301, though the number of wells 301 on a well pad 300 is a matter of design choice dependent on at least: location, formation boundaries, lease holder rights and investment funds. Each of the wells 301 on each well pad 300 may be drilled in succession or at different times. Each well 301 has a lateral wellbore 302 that is drilled as long as possible given the limitations of: lease holder rights, production zone boundaries, and lateral wellbore completion equipment and technology. Lateral wellbores 302 cross paths but do not directly intersect, to provide a "network" of drainage within the production zone. Since current completion technology permits the completion of very long lateral wellbores 300, they may be used to extract hydrocarbons underlying surface features such as a lake or reservoir 320; a river 330; a city, town or village 340; farm land 350; forest or recreational land 360; wet land (not shown) or the like. The network of drainage provided by the lateral wellbores is also suitable for EOR, since once produced some of the lateral wellbores 102 can be used as EOR flood fluid wellbores while others are used as EOR production bores.

The methods in accordance with the invention also permit an operator to close in a well when oil prices make production uneconomical. Once a currently producing section is depleted, it can be plugged and the well closed in until prices recover. Since the cased wellbore above the plug is not perforated, the well can be brought back online without any difficulty when oil prices recover to economic production levels.

The invention has been described with specific reference to wellbores in excess of 8,000'. However, the invention, is equally applicable to lateral wellbores that are less than 8,000' long. The scope of the invention is therefore intended to be limited solely by the scope of the appended claims.

I claim:

1. A method of preparing to produce hydrocarbons from a cased and cemented long lateral wellbore, comprising:

selecting a length of a first production section at a furthest reach of the long lateral wellbore, the selected length of the first production section being less than a total length of the long lateral wellbore;

perforating the cased and cemented long lateral wellbore in discrete perforating runs and selecting a length of each perforation run with consideration to re-stimulation of the first production section at a later date by taking into account potential pressure loss in a work string that may be used for the re-stimulation procedure given:

a diameter of the casing of the long lateral wellbore, which determines a diameter of the work string that can be used for the re-stimulation; and a distance of the first production section from a wellhead of the long lateral wellbore; and leaving unperforated intervals between the perforated runs, the unperforated intervals being at least one casing joint in length.

2. The method as claimed in claim 1 wherein after perforating and stimulating the first section of the long lateral wellbore, the method further comprises running production tubing and an associated packer into the long lateral wellbore and producing hydrocarbons from the long lateral wellbore until production from the long lateral wellbore is no longer commercially viable.

3. The method as claimed in claim 2 further comprising pulling production tubing and the associated packer from the long lateral wellbore;

running stimulation equipment into the long lateral wellbore and re-stimulating each perforation run of the first production section of the long lateral wellbore;

flowing back re-stimulation fluids;

running the production equipment back into the wellbore; and again producing hydrocarbons from the first production section of the long lateral wellbore.

4. The method as claimed in claim 2 wherein after producing hydrocarbons from the first production section until production form the first production section is no longer commercially viable, the method further comprises running a plug into the long lateral wellbore and setting the plug in an unperforated section of the long lateral wellbore before a first perforated run of the first production section, selecting a length of a next production section of the long lateral wellbore, perforating the next production section in discrete perforation runs separated by unperforated intervals, stimulating the next production section and flowing back stimulation fluids, and producing hydrocarbons from the next production section using production equipment until the hydrocarbon production is no longer commercially viable.

5. The method as claimed in claim 4 further comprising:

pulling the production equipment from the long lateral wellbore;

pulling from the long lateral wellbore the plug set between the first production section and the next production section;

running in a packer and work string and setting the packer to pack off the casing where the plug was pulled from the casing of the long lateral wellbore;

installing a production tubing at a wellhead of the long lateral wellbore;

pumping enhanced oil recovery (EOR) flood fluid down the work string into the first production section of the long lateral well bore; and producing hydrocarbon up the annulus of the production casing and through the production tubing installed at the wellhead as the EOR flood fluid is pumped down the tubing.

6. The method as claimed in claim 4 wherein after producing hydrocarbons from the first and next production sections until production from the first and next production sections is exhausted or no longer commercially viable, the method further comprises:

pulling the production equipment from the wellbore;

removing the plug between the first production section and the next production section of the long lateral wellbore;

running stimulation equipment into the long lateral wellbore and re-stimulating the first and next production sections of the long lateral wellbore;

flowing back re-stimulation fluids;

running the production equipment back into the long lateral wellbore; and producing hydrocarbons from the first and next production sections in unison until hydrocarbon production is exhausted or no longer commercially viable.

7. The method as claimed in claim 2 further comprising selecting a length of the next production section of the long lateral wellbore using production information obtained during production from the first production section of the long lateral wellbore.

8. The method as claimed in claim 1 wherein the long lateral well bore is one of a plurality of long lateral wellbores drilled from one well pad.

9. The method as claimed in claim 8 further comprising using a different stimulation procedure or a different stimulation service provider for stimulating the first production section of each of the plurality of long lateral wellbores drilled from the one well pad.

10. The method as claimed in claim 9 further comprising comparing production information from each of the plurality of long lateral well bores to determine which stimulation procedure or stimulation service provider yielded the best production from the first production section of each of the plurality of long lateral wellbores.

11. The method as claimed in claim 10 further comprising selecting the stimulation procedure or the stimulation service provider that yielded the best production to complete the second production section of each of the plurality of long lateral well bores drilled from the one well pad.

12. The method as claimed in claim 1 wherein the first production section has a length of not less than about 2,000 linear feet to not more than about 4,000 linear feet.

13. A method of enhanced oil recovery from a cased and cemented long lateral wellbore after hydrocarbons have been produced from first and second sections of the long lateral wellbore until hydrocarbon production from each of the first and second sections is no longer commercially viable, comprising:

running production equipment into the long lateral wellbore until a packer of the production equipment is in the unperforated interval of the casing between the first and next production sections of the long lateral wellbore;

setting the packer in the unperforated interval to seal an annulus around a production tubing of the production equipment;

pumping enhanced oil recovery flood fluid through a wellhead and down an annulus of the long lateral wellbore to perforations in the casing of the next production section; and producing hydrocarbons and enhanced oil recovery fluid through the production tubing until the production of hydrocarbons is no longer commercially viable.

14. The method as claimed in claim 13 further comprising using a pump to pump the hydrocarbons and enhanced oil recovery fluid up through the production tubing.

15. The method as claimed in claim 12 wherein if hydrocarbons have not been produced from the entire well bore, the method further comprises preparing a further production section of the wellbore for production, ensuring that a length of an unperforated interval between the next and the further production sections is at least a casing joint in length.

16. A method of producing hydrocarbons from a cased and cemented long lateral wellbore, comprising:

drilling a plurality of long lateral wellbores from a single well pad and casing and cementing each of the plurality of long lateral wellbores; and preparing for production a first production section at a furthest reach of each of the respective long lateral wellbores, the respective first production sections having a length of less than a total length of the respective long lateral wellbores, and producing hydrocarbons from the respective first production sections until hydrocarbon production from each of the respective first production sections is no longer commercially viable;

running a plug into each of the respective long lateral wellbores after hydrocarbon production from each of the respective first production sections is no longer commercially viable, and setting the respective plugs in an unperforated section of the respective long lateral wellbores before the first production section;

planning a length of respective next production sections of the respective long lateral wellbores; and leaving an unperforated interval between the first production section of each of the respective plurality of long lateral wellbores and the next production section of each of the respective plurality of long lateral wellbores, each of the respective unperforated intervals being at least one casing joint in length.

17. The method as claimed in claim 16 wherein the planning of the length of the respective next production sections of the respective long lateral wellbores comprises using production information obtained during production from the first production sections of the respective long lateral wellbores.

18. The method as claimed in claim 16 wherein the first production sections of the respective long lateral wellbores have a respective length of not less than about 2,000 linear feet to not more than about 4,000 linear feet.

19. The method as claimed in claim 18 wherein the respective long lateral wellbores have a respective length of at least 10,000 linear feet.

20. The method as claimed in claim 16 further comprising locating the single well pad on an accessible portion of a public road right of way to minimize environmental impact.

* * * * *